United States Patent [19]

Kawagoe et al.

[11] Patent Number: 4,602,606

[45] Date of Patent: Jul. 29, 1986

[54] DIESEL ENGINE EXHAUST GAS RECIRCULATION SYSTEM WITH GREATER ATMOSPHERIC PRESSURE COMPENSATION AT LOW ENGINE LOAD

[75] Inventors: Michio Kawagoe, Toyota; Osamu Hishinuma, Kariya, both of Japan

[73] Assignees: Toyota Jidosha Kabushiki Kaisha, Toyota; Nippon Denso Kabushiki Kaisha, Kariya, both of Japan

[21] Appl. No.: 652,013

[22] Filed: Sep. 19, 1984

[30] Foreign Application Priority Data

Sep. 19, 1983 [JP] Japan ..... 58-173795
Oct. 20, 1983 [JP] Japan ..... 58-196695

[51] Int. Cl.[4] ..... F02M 25/06
[52] U.S. Cl. ..... 123/569; 123/571
[58] Field of Search ..... 123/568, 569, 571

[56] References Cited

U.S. PATENT DOCUMENTS 4,375,800 3/1983 Otsuka et al. ..... 123/569
4,387,693 6/1983 Romblom ..... 123/569
4,399,799 8/1983 Romblom et al. ..... 123/569
4,411,242 10/1983 Igashira et al. ..... 123/569
4,416,243 11/1983 Naito et al. ..... 123/569
4,488,533 12/1984 Sekiguchi et al. ..... 123/569

FOREIGN PATENT DOCUMENTS 0040809 3/1981 Japan .
0118609 8/1981 Japan .
0103169 6/1982 Japan .
0103170 6/1982 Japan .
0191440 11/1982 Japan ..... 123/569
0063416 4/1983 Japan .

*Primary Examiner*—Willis R. Wolfe, Jr.
*Attorney, Agent, or Firm*—Oblon, Fisher, Spivak, McClelland & Maier

[57] ABSTRACT

An exhaust gas recirculation system for a diesel engine and which includes an exhaust gas recirculation passage connecting between the exhaust system and the air intake system of the engine, an exhaust gas recirculation control valve which regulates the flow resistance of the exhaust gas recirculation passage according to the amount by which the pressure in its pressure chamber is lower than atmospheric, a mechanism for providing a supply of low pressure, an absolute pressure control valve which receives a supply of low pressure from such mechanism at its input port and provides a supply of a pressure at its output port the absolute pressure value of which is substantially fixed, and a vacuum control valve which has a pressure regulating chamber which receives supply of pressure from the output port of the absolute pressure control valve and also has an output port opening from the pressure regulating chamber. The vacuum control valve is controlled according to engine load, and bleeds the pressure regulating chamber to the atmosphere when the pressure therein is at or below a certain pressure value, this certain pressure value increasing in accordance with increasing engine load. The output port of the vacuum control valve is communicated to the pressure chamber of the exhaust gas recirculation control valve.

9 Claims, 4 Drawing Figures

DIESEL ENGINE EXHAUST GAS RECIRCULATION SYSTEM WITH GREATER ATMOSPHERIC PRESSURE COMPENSATION AT LOW ENGINE LOAD

BACKGROUND OF THE INVENTION

Field of the Invention

The present invention relates to an exhaust gas recirculation system for a diesel engine, and more particularly relates to an exhaust gas recirculation system for a diesel engine in which altitude compensation is performed according to engine load in an appropriate fashion.

The present patent application has been at least partially prepared from material which has been included in Japanese Patent Applications Nos. Sho 58-173795 (1983) and Sho 58-196695 (1983), which were invented by the same inventors as the present patent application.

DISCUSSION OF THE BACKGROUND

It is known to provide exhaust gas recirculation for a diesel engine, in order to reduce the quantities of NOx (nitrogen oxides) in the exhaust gases of the engine; and this is effective for improving exhaust quality, but the amount of recirculation of the exhaust gases is required to be properly controlled. In such an exhaust gas recirculation system, a quantity of exhaust gas is recirculated from the exhaust system of the engine to the intake system thereof, so as to replace some of the air that would otherwise be inhaled by the diesel engine. It is acceptable to thus recirculate an amount of exhaust gas which is less than or equal to the excess air amount of the engine, in other words which is less than or equal to the amount by which the volume of air sucked into the engine, if no exhaust gas recirculation were performed, would be excessive for combustion of the amount of diesel fuel currently being injected into the combustion chambers of the engine. Further, in order to reduce NOx as much as possible and thus to improve the quality of exhaust emissions as much as possible, it is desirable to thus recirculate an amount of exhaust gas substantially equal to said excess air amount. However, it is very undesirable to thus recirculate exhaust gases in a greater amount than said excess air amount, because this will cause the engine not to be inhaling sufficient air and oxygen for complete combustion of the amount of fuel currently being injected into its cylinders, which can cause loss of engine performance and drivability, as well as mayhap causing emission of black smoke from the diesel engine in the case of medium and high load operation, emission of white smoke from the diesel engine in the case of low load or idling operation, and possibly also causing misfiring in such low load or idling operation.

The excess air amount of a diesel engine of course varies as the load on the engine varies; specifically, at low engine load the excess air amount is the greatest, and this excess air amount decreases as the engine load increases. According to this, therefore, there have been proposed various exhaust gas recirculation systems for diesel engines, and control systems therefor, which provide an amount of exhaust gas recirculation which varies with the engine load, being greatest when the engine load is least, and being diminished as the engine load increases.

However, when the effects of vehicle operational altitude upon the operation of such an exhaust gas recirculation system are considered, complications tend to arise. A diesel engine operating without any exhaust gas recirculation aspires lesser amounts (by mass) of air and therefore of oxygen at higher altitudes, i.e. at lower ambient atmospheric pressures, and accordingly the air excess ratio of a diesel engine is lower, the lower is the ambient atmospheric pressure. Therefore, the maximum acceptable amount of exhaust gas recirculation for a diesel engine becomes smaller as the ambient atmospheric pressure drops, and accordingly an exhaust gas recirculation system and the control system therefor should be able to take account of the ambient atmospheric pressure, and should reduce the exhaust gas recirculation ratio according to a drop in such ambient atmospheric pressure.

According to such requirement, there have been proposed various exhaust gas recirculation systems equipped with altitude compensation, in particular in Japanese Patent Application No. 56-40809 (which has been published as Japanese Patent Laying Open Publication No. 57-157047), Japanese Patent Application No. 57-103169, Japanese Patent Application application No. 57-103170, and Japanese Patent Application No. 58-063416, none of which is it intended by this discussion to admit as prior art in the legal sense to this application except inasmuch as otherwise required by law.

However, the problem with such prior proposals is that they do not provide perfect altitude compensation. In detail, the amount of exhaust gas recirculation provided to the diesel engine should as mentioned above be decreased as the altitude increases and accordingly the ambient atmospheric pressure decreases, but this amount of exhaust gas recirculation decreasing should be greater in regions of low engine load than in regions of medium to high engine load, so as better to avoid the engine lacking air in such low engine load operational regions and thus being subject to the emission of white smoke, as well as to avoid engine misfiring and poor drivability and the like in these low engine load operational regions.

SUMMARY OF THE INVENTION

Accordingly, it is the primary object of the present invention to provide an exhaust gas recirculation system for a diesel engine, which has good altitude compensation.

It is a further object of the present invention to provide such an exhaust gas recirculation system for a diesel engine, which appropriately provides reduction of exhaust gas recirculation with an increase in altitude.

It is a further object of the present invention to provide such an exhaust gas recirculation system for a diesel engine, which thus reduces exhaust gas recirculation with an increase in altitude in a way which is appropriate to and takes into account the engine load.

It is a further object of the present invention to provide such an exhaust gas recirculation system for a diesel engine, which reduces exhaust gas recirculation with an increase in altitude to a greater extent at low engine load than at medium or high engine load.

It is a further object of the present invention to provide such an exhaust gas recirculation system for a diesel engine, which provides substantially the maximum acceptable and practicable amount of exhaust gas recirculation consistent with proper engine operation substantially at all times, even when the engine is operated at a high altitude.

It is a yet further object of the present invention to provide such an exhaust gas recirculation system for a diesel engine, which keeps the quality of the exhaust emissions of the engine high at all altitudes.

It is a yet further object of the present invention to provide such an exhaust gas recirculation system for a diesel engine, which keeps the amount of NOx in the exhaust emissions of the engine low at all altitudes.

It is a yet further object of the present invention to provide such an exhaust gas recirculation system for a diesel engine, which does not risk that incomplete fuel combustion would occur during engine operation at any engine altitude.

It is a yet further object of the present invention to provide such an exhaust gas recirculation system for a diesel engine, which does not risk the occurrence at any altitude during medium or high load operation that the engine should emit substantial quantities of black smoke.

It is a yet further object of the present invention to provide such an exhaust gas recirculation system for a diesel engine, which does not risk the occurrence at any altitude during low load or idling operation that the engine should emit substantial quantities of white smoke.

It is a yet further object of the present invention to provide such an exhaust gas recirculation system for a diesel engine, which does not risk the occurrence at any altitude during low load or idling operation that the engine should misfire.

It is a yet further object of the present invention to provide such an exhaust gas recirculation system for a diesel engine, which ensures that at any altitude the diesel engine is substantially never starved of air.

It is a yet further object of the present invention to provide such an exhaust gas recirculation system for a diesel engine, which ensures that the performance of the diesel engine is kept good at all altitudes.

It is a yet further object of the present invention to provide such an exhaust gas recirculation system for a diesel engine, which ensures that the drivability of the diesel engine is kept good at all altitudes.

According to an aspect of the present invention, these and other objects are accomplished by providing an exhaust gas recirculation system for a diesel engine for a vehicle, utilizing an air intake system and an exhaust system, comprising: (a) an exhaust gas recirculation passage a downstream end of which is connected to said exhaust system and an upstream end of which is connected to said air intake system, so as to recirculate exhaust gas from said exhaust system to said air intake system; (b) an exhaust gas recirculation control valve, comprising a pressure chamber, which regulates the flow resistance of said exhaust gas recirculation passage according to the amount by which the pressure in said pressure chamber is lower than the ambient atmospheric pressure, so as to regulate the flow amount of said recirculation of exhaust gas from said exhaust system to said air intake system; (c) means for providing a supply of low pressure; (d) an absolute pressure control valve comprising an input port and an output port, which receives supply of low pressure from said means for providing low pressure at said input port, and which provides a supply of a pressure at said output port the absolute pressure value of which is substantially fixed; and (e) a vacuum control valve comprising a pressure regulating chamber which receives supply of pressure from said output port of said absolute pressure control valve, and further comprising an output port opening from said pressure regulating chamber, said vacuum control valve being controlled according to engine load, and bleeding to atmosphere said pressure regulating chamber when the pressure therein is at or below a certain pressure value, said certain pressure value increasing in accordance with increasing engine load; and said output port of said vacuum control valve being communicated to said pressure chamber of said exhaust gas recirculation control valve.

According to such structure, when the vehicle incorporating the system is used at a low altitude at which the ambient atmospheric pressure is quite close to standard atmospheric pressure, the supply of low pressure from the absolute pressure control valve is sufficient to lower the pressure of the pressure regulating chamber to said certain pressure value set by the operation of the vacuum control valve according to engine load, whatever the value of engine load may be; and accordingly the exhaust gas recirculation control valve is controlled according to the value of engine load by the pressure in said pressure regulating chamber which is adjusted to be substantially equal to said certain pressure value at all engine load values. Now, in general, considering vehicle operation at a fixed engine load, when the vehicle incorporating the system is used at progressively higher and higher altitudes so that the ambient atmospheric pressure is steadily reduced, provided that lowering of the pressure in said pressure regulating chamber is not limited by the pressure value of the supply of low pressure from the absolute pressure control valve thereto, as this occurs the amount by which the pressure in said pressure chamber of the exhaust gas recirculation control valve is lower than the ambient atmospheric pressure decreases, so that the amount of exhaust gas recirculation drops. Accordingly, the amount of exhaust gas recirculation is reduced in all operational conditions of the diesel engine substantially evenly, thus showing that this exhaust gas recirculation control system is able to take into account the ambient atmospheric pressure, and reduces the exhaust gas recirculation ratio according to a drop in such ambient atmospheric pressure, as is desirable as explained previously in this specification. Further, on the other hand, when the altitude at which the vehicle is being operated becomes sufficiently high, then the abovementioned provision is no longer valid, and, in low engine load operation and only therein, the lowering of the pressure in the pressure regulating chamber towards said certain pressure value becomes limited by the pressure value of the supply of low pressure from the absolute pressure control valve thereto, so that, now, said pressure in the pressure regulating chamber cannot attain said certain value; in other words, the output pressure of the vacuum control valve becomes limited by said fixed output pressure value of the supply of low pressure from the absolute pressure control valve, only in said low engine load operational region, and not in the medium to high load engine operational region. Accordingly, the amount of exhaust gas recirculation provided in said low engine load operational region is sharply reduced, by a much greater amount than the above explained reduction of exhaust gas recirculation provided across the entire operating range of the diesel engine. This ensures that the amount of exhaust gas recirculation provided to the diesel engine is decreased as the altitude increases and accordingly the ambient atmospheric pressure decreases, and that, as is desirable as explained previously, this amount of exhaust gas recirculation decreasing is greater in regions of low engine load than in regions of medium to high engine load, so as better to avoid the engine lacking air in such low engine load operational regions and thus being subject to the emission of white smoke, as well as to avoid engine misfiring and poor drivability and the like in these low engine load operational regions.

According to an alternative aspect of the present invention, these and other objects are accomplished by an exhaust gas recirculation system for a diesel engine for a vehicle utilizing an intake system and an exhaust system, comprising: (a) an exhaust gas recirculation passage a downstream end of which is connected to said exhaust system and an upstream end of which is connected to said air intake system, so as to recirculate exhaust gas from said exhaust system to said air intake system; (b) an exhaust gas recirculation control valve comprising a pressure chamber, which regulates the flow resistance of said exhaust gas recirculation passage according to the amount by which the pressure in said pressure chamber is lower than the ambient atmospheric pressure, so as to regulate the flow amount of said recirculation of exhaust gas from said exhaust system to said air intake system; (c) means for providing a supply of low pressure; (d) an absolute pressure control valve comprising an input port and an output port, which receives supply of low pressure from said means for providing low pressure at said input port, and which provides a supply of a pressure at said output port the absolute pressure value of which is substantially fixed; (e) a regulator valve comprising an input port and an output port, said regulator valve receiving at said input port supply of said pressure at said output port of said absolute pressure control valve the absolute pressure value of which is substantially fixed, and producing at said output port an output pressure value which depends upon engine load; and (f) a vacuum control valve comprising a pressure regulating chamber which receives supply of pressure from said means for providing low pressure and an output port opening from said pressure regulating chamber, and in accordance with increasing engine load increasing an absolute pressure value at and below which pressure in said pressure regulating chamber is bled to atmosphere, and further comprising a control chamber which receives a supply of said output pressure value from said output port of said regulator valve and which controls the bleeding of said pressure regulating chamber to the atmosphere according to the pressure therein by altering said certain pressure value, said output port of said vacuum control valve being communicated to said pressure chamber of said exhaust gas recirculation control valve.

According to such structure, when the vehicle incorporating the system is used at a low altitude at which the ambient atmospheric pressure is quite close to the standard atmospheric pressure, then the supply of low pressure from the absolute pressure control valve is of sufficiently low pressure to be appropriately modified by the regulator valve according to engine load, for controlling the vacuum control valve, whatever the value of engine load may be; and accordingly the exhaust gas recirculation control valve is controlled according to the value of engine load by the pressure in said pressure regulating chamber at all engine load values. Again, in general, considering vehicle operation at a fixed engine load, when the vehicle incorporating the system is used at progressively higher and higher altitudes so that the ambient atmospheric pressure is steadily reduced, provided that the output pressure from the regulator valve is not limited by the pressure value of the supply of low pressure from the absolute pressure control valve thereto, as this occurs the amount by which the pressure in the pressure chamber of the exhaust gas recirculation control valve is lower than the ambient atmospheric pressure decreases, so that the amount of exhaust gas recirculation drops. Accordingly, the amount of exhaust gas recirculation is reduced in all operational conditions of the diesel engine substantially evenly, thus showing that this exhaust gas recirculation control system, again, is able to take account of the ambient atmospheric pressure, and reduces the exhaust gas recirculation ratio according to drop in such ambient atmospheric pressure, as is desirable as explained previously in this specification. Further, on the other hand, when the altitude at which the vehicle is being operated becomes sufficiently high, then the abovementioned provision is no longer valid, and, in low engine load operation and only then, the output pressure of the regulator valve becomes limited by the pressure value of the supply of low pressure from the absolute pressure control valve thereto, so that, now, said output pressure of the regulator valve cannot attain the value which it would attain if sufficiently low pressure supply were provided to said regulator valve; in other words, the output pressure of the regulator valve becomes limited by said fixed output pressure value of the supply of low pressure from the absolute pressure control valve, only in said low engine load operational region, and not in the medium to high load engine operational region. Accordingly, the amount of exhaust gas recirculation provided in said low engine load operational region is sharply reduced, by a much greater amount than the above explained reduction of exhaust gas recirculation provided across the entire operating range of the diesel engine. This, again as before, ensures that the amount of exhaust gas recirculation provided to the diesel engine is decreased as the altitude increases and accordingly the ambient atmospheric pressure decreases, and that, as is desirable as explained previously in this specification, this amount of exhaust gas recirculation decreasing is greater in regions of low engine load than in regions of medium to high engine load, so as better to avoid the engine lacking air in such low engine load operational regions and thus being subject to the emission of white smoke, as well as to avoid engine misfiring and poor drivability and the like in these low engine load operational regions.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, all of which are given purely for the purposes of explanation and exemplification only, and are not intended to be limitative of the scope of the present invention in any way, since the scope of the present invention is to be defined solely by the legitimate and proper scope of the appended claims. In the drawings, like parts and features are denoted by like reference symbols in the various figures thereof, and wherein:

DESCRIPTION OF THE PREFERRED EMBODIMENTS

Figure 1:
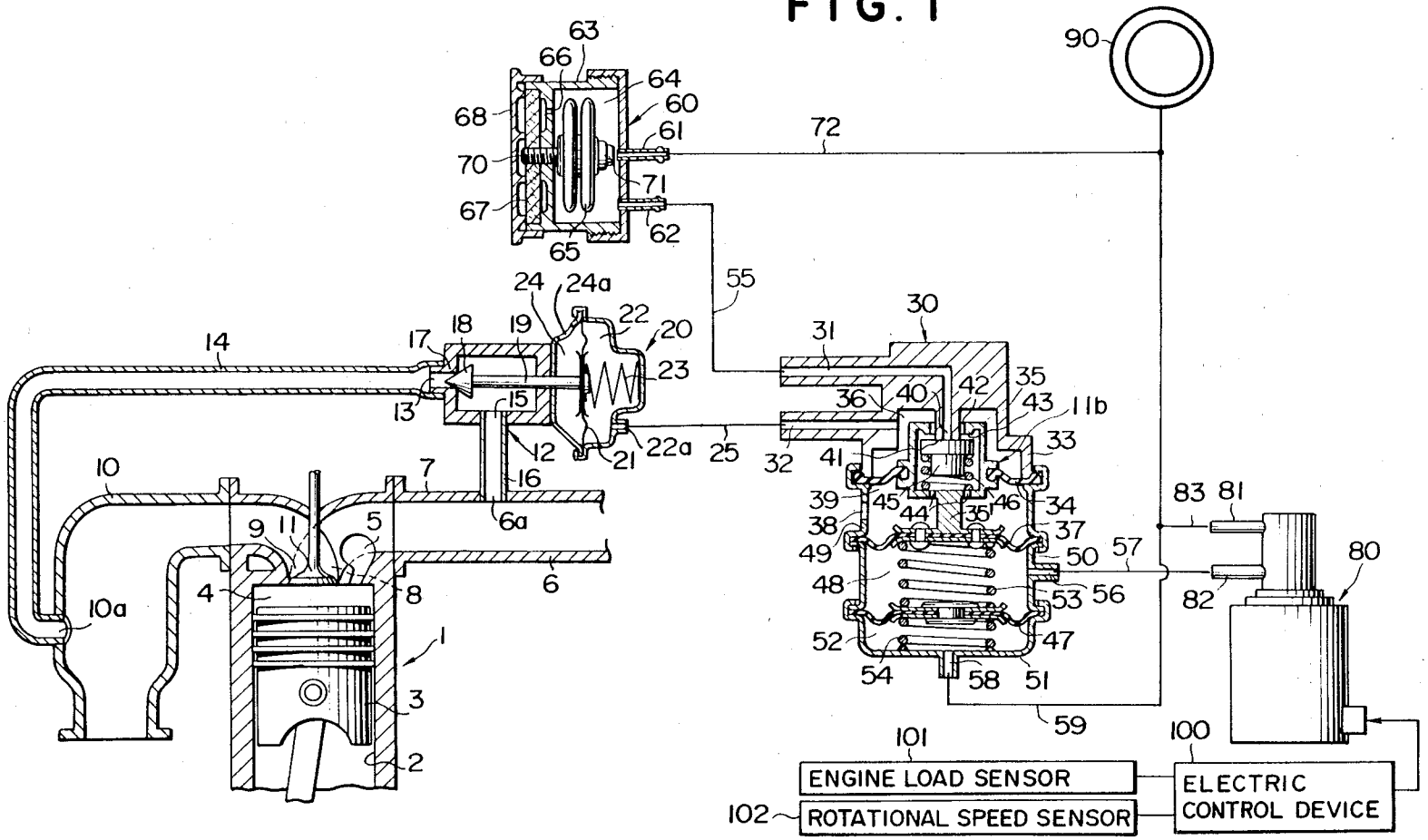
FIG. 1 is a schematic, partial sectional view, showing parts of a diesel engine and of the first preferred embodiment of the diesel exhaust gas recirculation system of the present invention in cross section.

The present invention will now be described with reference to the preferred embodiments thereof, and with reference to the appended drawings. FIG. 1 shows a diesel internal combustion engine 1 in partial cross section wherein engine 1 has a cylinder bore 2 within which a piston 3 reciprocates, being pivotally connected to one end of a connecting rod the other end, not shown, of which is pivotally connected to a crank pin of a crankshaft, also not shown. While the diesel engine 1 has a plurality of such cylinder bore and piston combinations, only one of them is visible in the plane of the figure. Above the piston 3, between it and a cylinder head, is defined a combustion chamber 4, and a swirl chamber 5 is formed within said cylinder head and is communicated to the combustion chamber 4. A fuel injection nozzle, not shown, is provided for injecting liquid fuel at high pressure into this swirl chamber 5. Into the combustion chamber 4 is opened an intake port 8 and an exhaust port 9. To the intake port 8 there is connected the downstream end of an intake passage member 6, and to the exhaust port 9 there is connected the upstream end of an exhaust passage member 10. The intake port 8 and the exhaust port 9 are controlled by poppet valves which open and close them wherein in FIG. 1 only the exhaust poppet valve 11 can be seen.

The first preferred embodiment of the exhaust gas recirculation system of the present invention comprises an exhaust gas recirculation control valve 12, which has an input port 13 and an output port 15, also comprises a first exhaust gas recirculation passage portion 14 the upstream end of which is connected to an exhaust gas takeout port 10*a* provided in the exhaust passage member 10 and the downstream end of which is connected to said input port 13 of said exhaust gas recirculation control valve 12, and further comprises a second exhaust gas recirculation passage portion 16 the upstream end of which is connected to said output port 14 of said exhaust gas recirculation control valve 12 and the downstream end of which is connected to an exhaust gas feed-in port 6*a* provided in the intake passage member 6. This exhaust gas recirculation control valve 12 controls the flow resistance between its input port 13 and its output port 15 according to the vacuum value supplied to its control port 22*a*, more exactly according to the relative negative pressure supplied to said control port 22*a*, i.e. according to the difference between the absolute value of the pressure supplied to said control port 22*a* and the current or ambient value of atmospheric pressure.

The structure of the exhaust gas recirculation control valve 12 is as follows: such comprises a valve element 18 mounted on the one end of a valve rod 19 the other end of which is connected to a diaphragm 21 of a diaphragm actuator 20. When the valve element 18 an the valve rod 19 are driven leftwards in the figure by the diaphragm actuator 20, the valve element 18 is pressed against the opening in a valve seat 17 and closes it, thereby discommunicating the input port 13 and the output port 15 of the exhaust gas recirculation control valve 12 from one another. On the other hand, according as the valve element 18 and the valve rod 19 are driven more and more rightwards in the figure from this position by the diaphragm actuator 20, the valve element 18 is moved away from said opening in said valve seat 17 and opens it more and more, thereby more and more reducing the flow resistance between said input port 13 and said output port 15 of the exhaust gas recirculation control valve 12. In the diaghragm actuator 20, the diaghragm 21 to which the valve rod 19 is fixed separates an atmospheric pressure chamber 24 on the left in the figure from a pressure chamber 22 on the right, and the diaghragm 21 is biased leftwards in the figure by a compression coil spring 23 fitted in said pressure chamber 22. Air at atmospheric pressure is admitted into the atmospheric pressure chamber 24 through a vent 24*a*, and a supply of actuating vacuum is provided to the pressure chamber 22 through the aforementioned control port 22*a*. Thus, according to the value of the difference between the absolute value of the presssure supplied to said control port 22*a* and the current value of atmospheric pressure, only however when said pressure difference has become greater than some predetermined threshold value, the diaphragm 21 is displaced rightwards in the figure against the compression force of the compression coil spring 23, and the valve rod 19 and the valve element 18 are likewise displaced rightwards, thus correspondingly lowering the flow resistance between the input port 13 of the exhaust gas recirculation control valve 12 and the output port 15 thereof.

The control port 22*a* is connected, via a conduit 25, to an output port 32 of a vacuum control valve 30 which will now be described. This vacuum control valve 30 is of a type developed by colleagues of the present inventors in the same workplace as the present inventors; Japanese Patent Application No. 58-063416 has been filed for an inventive concept embodied in said vacuum control valve 30, but this patent application had not been published at the time of filing of the Japanese applications the priorities of which are being claimed in the present application, and it is not intended by this discussion to admit this matter as prior art in the legal sense to this application except inasmuch as otherwise required by law. This vacuum control valve 30 has this output port 32 as its sole output port, further has an input port 56, and also has an atmospheric port 38, a reference pressure port 58, and a regulated pressure port 31. The body of the vacuum control valve 30 is made as a stack consisting of a base casing 33, intermediate casings 49 and 50, and a cover casing 51, fixed to one another in the specified order from the top of FIG. 1 towards its bottom, with first through third diaphragms 34, 37, and 47 fitted between them in turn in the same order, and within these four casings there are respectively defined four pressure chambers likewise in a stack: again in order from the top to the bottom as seen in FIG. 1, a pressure regulated chamber 36 within the base casing 33, an atmospheric pressure chamber 39 within the intermediate casing 49 and separated from the pressure regulated chamber 36 by said first diaphragm 34 which is clamped between the meeting portions of the base casing 33 and the intermediate casing 49, a pressure chamber 48 within the intermediate casing 50 and separated from the atmospheric pressure chamber 39 by said second diaphragm 37 which is clamped between the meeting portions of the intermediate casing 49 and the intermediate casing 50, and another reference pressure chamber 52 within the cover casing 51 and separated from the pressure chamber 48 by said third diaphragm 47 which is clamped between the meeting portions of the intermediate casing 50 and the cover casing 51. The aforesaid output port 32 opens from the pressure regulated chamber 36, and also the regulated pressure port 31 opens within this pressure regulated chamber 36, protruding thereinto as a valve port 40 at the inner end of which there is defined a valve seat 41 the opening and closing of which are controlled by a compound valve member assembly 111 which will be explained shortly, selectively abutting theregainst. Also, the pressure regulated chamber 36 is in some circumstances communicated with the atmospheric pressure chamber 39 by a plurality of restricted orifices 44 in the body member 35 of the compound valve member assembly 111, which is fitted so as to penetrate through the first diaphragm 34, as will be explained shortly. The atmospheric pressure chamber 39 is opened to the atmosphere via the relatively large atmospheric port 38, and accordingly the air within it is always at atmospheric pressure. The presssure chamber 48 is connected via the input port 56 to one end of a conduit 57. And the reference pressure chamber 52 is connected via the reference pressure port 58 to one end of another conduit 59. A first compression coil spring 53 is mounted within the pressure chamber 48 and its ends bear on the second diaphragm 37 and on the third diaghragm 47 and bias them, respectively, upwards and downwards in the figure. And a second compression coil spring 54 is mounted within the reference pressure chamber 52 and its ends bear on the third diaphragm 47 and on the inside of the cover casing 51, thus biasing said third diaphragm 47 upwards in FIG. 1.

The compound valve member assembly 111 has the aforementioned body member 35, which is generally formed in the shape of a hollow barrel with an axial stalk 35' protruding from its lower end in the figure and with an axial hole 42 formed in its upper end surface. The body member 35 extends through a hole in the first diaphragm 34, with the inner circumferential edge of this hole in said first diaphragm 34 fitting closely and gas-tightly around the outer surface of the barrel shape of the body member 35 and fitting into a circumferential groove defined between two circumferential flanges formed thereon, and with the axial stalk 35' protruding downwards in the figure and being securely coupled via rivets and a backing washer and so on to the central portion of said second diaphragm 37. Thus, the aforementioned restricted orifices 44, which are formed through the lower end surface of the barrel shape of the body member 35 from its inside to its outside and displaced sideways from the base of the axial stalk 35', bypass the sealing action of the first diaphragm 34, and in conjunction with the axial hole 42 through the upper end of the body member 35 (when said hole 42 is open) communicate the pressure regulated chamber 36 with the atmospheric pressure chamber 39 with a certain fairly high flow resistance being provided therebetween, due to the restricted size of said holes 44. Within the substantially cylindrical internal space of the barrel shape of the body member 35 there is axially movably received a valve element 45 which is made of a resilient material such as rubber, and this valve element 45 is biased upwards in the figure with respect to the body member 35 by a compression coil spring 46 fitted between it and the internal side of the lower end of the barrel shape of the body member 35.

Thus, when as shown in FIG. 1 the first diaphragm 34 and the body member 35 of the compound valve member assembly 111 are in their upwardly displaced positions, the upper surface of the valve element 45 is thereby pressed against and closes the valve seat 41 defined at the inner end of the valve port 40, and this pressure also causes said valve element 45 to be biased somewhat downwards in the figure with respect to the body member 35, so that it is not pressed against the annular end surface 42 of said axial hole 42 and accordingly does not close said hole 42, thus allowing passage of air through said hole 42 on the side of the valve port 40; and in this position the regulated pressure port 31 is discommunicated from the pressure regulated chamber 36 by the valve port 40 being thus closed by the valve element 45, while the pressure regulated chamber 36 is, as mentioned above, communicated with the atmospheric pressure chamber 39 via the hole 42 and the restricted apertures 44 with a considerable flow resistance being interposed therebetween. But, on the other hand, when said first diaphragm 34 and said body member 35 of said compound valve member assembly 111 are in their downwardly displaced positions, the upper surface of the valve element 45 is brought away from said valve seat 41 at the inner end of said valve port 40 and thus opens said valve seat 41, and also the valve element 45 is released from being pushed downwards in the figure with respect to the body member 35 of the compound valve member assembly 111 so that it is biased upwards in the figure by the compression coil spring 46 and is pressed against the lower annular end surface 43 of the axial hole 42 and closes said axial hole 42; and in this position the regulated pressure port 31 is communicated to the pressure regulated chamber 36, while said pressure regulated chamber 36 is, by the closing of the axial hole 42, substantially completely cut-off from the atmospheric pressure chamber 39.

Thus, the compound valve member assembly 111 is driven to and fro in the vertical direction in the figure under the influence of three forces: an upwards force caused by the pressure difference between the absolute pressures in the pressure regulated chamber 36 and in the atmospheric pressure chamber 39, i.e. proportional to the amount by which the absolute pressure in the pressure regulated chamber 36 is less than atmospheric pressure; a downward force caused by the pressure difference between the absolute pressures in the pressure chamber 48 and in the atmospheric pressure chamber 39, i.e. proportional to the amount by which the absolute pressure in the pressure chamber 48 is less than atmospheric pressure; and an upward force caused by the compression force of the first compression coil spring 53. Further, this compression force of this first compression coil spring 53 is equal to a constant value plus a value proportional to the amount by which the lower end of said compression coil spring 53 has been raised from the point of view in the figure above its lowermost position, i.e. to the amount by which the second diaphragm 47 is raised, i.e. plus a value proportional to the amount by which the difference between the absolute pressure in the pressure chamber 48 and the absolute pressure in the reference pressure chamber 52 is less than a certain predetermined pressure difference value (which is just sufficient fully to compress the second compression coil spring 54). In other words, if the absolute pressures in the pressure chambers 36, 39, 48, and 52 are respectively P1, PA=current external atmospheric pressure, P2, and P3, with P3 always being less than P2 as will be seen hereinafter and with P2 and P1 being less than PA, then the first above mentioned force acting upwards on the compound valve member assembly 111 is K1*(PA−P1); the above mentioned downward force acting on said compound valve member assembly 111 is K1*(PA−P2); and the second above mentioned force acting upwards on said compound valve member assembly 111 is K2−K3*(P2−P3), except that if P2−P3 rises to be greater than said certain predetermined value PD said second upward force ceases to drop below K2−K3*PD. In the above equations, K1, K2, and K3 are positive constants, with K3 less than K1; the areas of the first and second diaphragms 34 and 37 are assumed equal; and the equations are only valid to a first approximation,—in other words the effect of the movement of the second diaphragm 37 itself on the compression of the compression coil spring 53 is neglected: this will not introduce any error for the equilibrium pressure in the pressure regulated chamber 36, to be determined shortly. Thus, the total upward force on the compound valve member assembly 111 is equal to K1*(PA−P1)+K2−K3*(P2−P3), and the opposing total downward force thereon is K1*(PA−P2). Therefore, the net upward force on said assembly 111 is equal to K1*(P2−P1)+K2−K3*(P2−P3), which equals K2−P1*K1+P2*(K1−K3)+P3*K3, and said assembly 111 is displaced upwards or downwards, according as the sign of this expression is respectively positive or negative.

Now, the regulated pressure port 31 is, as will be explained shortly, supplied with a source of constant negative pressure, i.e. of pressure lower than atmospheric (if atmospheric pressure is high, as at sea level or near it), and accordingly, for given values of P2 and P3, when the value P1 of the absolute pressure in the pressure regulated chamber 36 is so low as to cause the above expression for the upwards force on the valve member assembly 111 to be positive, then as mentioned above the valve member assembly 111 is displaced upwards and intercepts the valve port 41 while communicating the pressure regulated chamber 36 to the atmospheric pressure chamber 39 via the restricted apertures 44 and so on, and hence the pressure in said pressure regulated chamber 36 rises at a certain relatively low speed; but, when on the other hand the value P1 of the absolute pressure in the pressure regulated chamber 36 rises to be so high as to cause the above expression for the upwards force on the valve member assembly 111 to be negative, then as mentioned above the valve member assembly 111 is displaced downwards and ceases to intercept the valve port 41 while at the same time discommunicating the pressure regulated chamber 36 from the atmospheric pressure chamber 39, and hence the pressure in said pressure regulated chamber 36 drops, provided that the value of the pressure supplied to the regulated pressure port 31 is below said pressure in said chamber 36. Accordingly, considering the values of P2 and P3 as being fixed, by an oscillatory action, with the valve member assembly 111 moving upwards and downwards repeatedly, the pressure in the pressure regulated chamber 36 is adjusted to be substantially equal to that value which will make the aforesaid upwards force on the valve member assembly 111 just equal to zero, except that said pressure in the chamber 36 cannot of course be brought to be any lower than the value of the pressure supplied to the regulated pressure port 31; in other words, with this provision, the absolute pressure P1 in the pressure regulated chamber 36 is brought to satisfy the condition that P1*K1=K2+P2*(K1−K3)+P3*K3.

This regulated pressure port 31 of the vacuum control valve 30 is connected, via the conduit 55, to an output port 62 of an absolute pressure control valve 60. This valve 60 has defined within its casing 63 a pressure chamber 64, into which said output port 62 opens and into which an input port 61 of said absolute pressure valve 60 also opens. This input port 61 is communicated, via a conduit 72, to the outlet of a vane type negative pressure pump or vacuum pump 90, which is operated to generate negative pressure at a relatively very low pressure value by being turned by the crankshaft of the engine 1, always while the engine 1 is being operated. The outlet of the vacuum pump 90 is also connected, via the aforementioned conduit 59, to the reference pressure port 58 of the vacuum control valve 30, and is yet further communicated, via part of said conduit 59 and via a conduit 83, to an input port 81 of a regulator valve 80, an output port 82 of which is connected via the aforementioned conduit 57 to the input port 56 of the vacuum control valve 30.

The pressure chamber 64 of the absolute pressure control valve 60 is also vented to the atmosphere with a certain fairly high flow resistance therebetween via a small aperture 66 in the casing 63 of said valve 60 and via an air filter and another small aperture 68. Within the chamber 64 there is mounted an aneroid bellows 65, with an axial screw 70 on one side of said aneroid bellows 65 being screwed into the housing 63, while the opposite axial tip 71 of said aneroid bellows 65 is opposed to and confronts the end of the input port 61 which therefore functions as a valve seat. As the absolute value of the pressure within the pressure chamber 64 increases, the aneroid bellows 65 is thereby compressed, and its tip 71 is moved leftwards in the figure away from the input port 61, thereby more and more opening said input port 61; but on the other hand, as the absolute value of the pressure within the pressure chamber 64 decreases, the aneroid bellows 65 is thereby allowed to expand, and its tip 71 is moved rightwards in the figure towards the input port 61, thereby more and more closing said input port 61. Thereby, provided that an adequately low basic supply of low absolute pressure (i.e. vacuum) is continually being provided from the vacuum pump 90, which is in fact the case, by an oscillatory action with the aneroid bellows 65 expanding and contracting repeatedly the pressure in the pressure chamber 64 is kept to be at a substantially constant absolute value, said substantially constant absolute value not depending in any way upon the external or ambient atmospheric pressure, but only depending upon the adjustment with respect to the housing 63 of the screw mount 70 of the aneroid bellows 65, and hence remaining constant during vehicle operation. This substantially constant absolute pressure is as mentioned above supplied to the regulated pressure port 31 of the vacuum control valve 30 via the conduit 55.

The regulator valve 80 may be of a type such as that disclosed in Japanese Utility Model Application Serial No. 56-1186019, which has been published, but it is not intended by this discussion to admit this matter as prior art in the legal sense to this application except inasmuch as otherwise required by law. This regulator valve 80 comprises a solenoid (not particularly shown) accomodated in a casing assembly and so on, and this solenoid receives an electrical control signal from an electrical control device 100 incorporating a microcomputer, which itself receives output electrical signals from an engine load sensor 101 (such as an accelerator pedal depression sensor) and an engine rotational speed sensor 102, as well as various other signals from other sensors which are not shown. According to this electrical control signal from the electrical control device 100, the regulator valve 80 modifies the value of the pressure supplied by the vacuum pump 90 to its input port 81, and supplies the resultant modified pressure to its output port 82, whence it is transmitted via the conduit 57 to the input port 56 of the vacuum control valve 30. The function of this regulator valve 80 is as follows: below a certain engine rotational speed (it will hereinafter and in the discussion of FIG. 2 be assumed that the actual engine rotational speed is below this certain rotational speed), the difference between the current value of atmospheric pressure and the absolute pressure output at the port 82—i.e., the amount of vacuum at said port 82—is maximum when engine load is minimum, and decreases linearly with an increase in engine load. In other words, given constant atmospheric pressure, the absolute pressure at the port 82 is minimum when engine load is minimum and increases linearly with engine load. Further, for any particular value of engine load, the absolute value of the output pressure of the regulator valve 80 at its port 82 increases as atmospheric pressure increases, although not necessarily at the same rate. This is a consequence of the internal construction and functioning of the regulator valve 80, and does not directly concern us here. In fact, this regulator valve 80 may receive from the electrical control device 100 an electrical signal which is a pulse signal which conveys information relating to engine load by means of its duty ratio, and may bleed atmospheric air into a supply of low pressure received from the pump 90 at its input port 81 to provide an output signal pressure at its output port 82 according to this duty ratio signal; but this is not directly relevant to the present invention.

Now, with reference to the graph of FIG. 2, the function of this first preferred embodiment of the diesel exhaust gas recirculation system of the present invention will be explained. In this explanation, various exemplary pressure values used or attained during the operation of a particular version of the system, operating in particular circumstances, will be cited; however, these are not intended to be limiting, but merely explicative.

First, with regard to the operation of the exhaust gas recirculation control valve 12, this valve is operated according to the relative negative pressure (or the depression) supplied to the pressure chamber 22 of its diaphragm actuator 20, in other words, according to the amount by which the absolute pressure supplied to said pressure chamber 22 from the output port 32 of the vacuum control valve 30 is less than the current value of atmospheric pressure. In the graphs of FIG. 2, it is assumed for the sake of explanation that this exhaust gas recirculation control valve 12 has the characteristic that it remains closed—i.e. valve element 18 remains pressed against its the valve seat 17—until the absolute pressure in the pressure chamber 22 drops to more than 150 mmHg below atmospheric pressure, and then it starts to open—i.e. valve element 18 starts to move rightwards away from its valve seat 17—until, when the absolute pressure in the pressure chamber 22 has dropped to more than 300 mmHg below atmospheric pressure, it is fully open—i.e. valve element 18 has fully moved away from valve seat 17 to the maximum possible amount.

Figure 2:
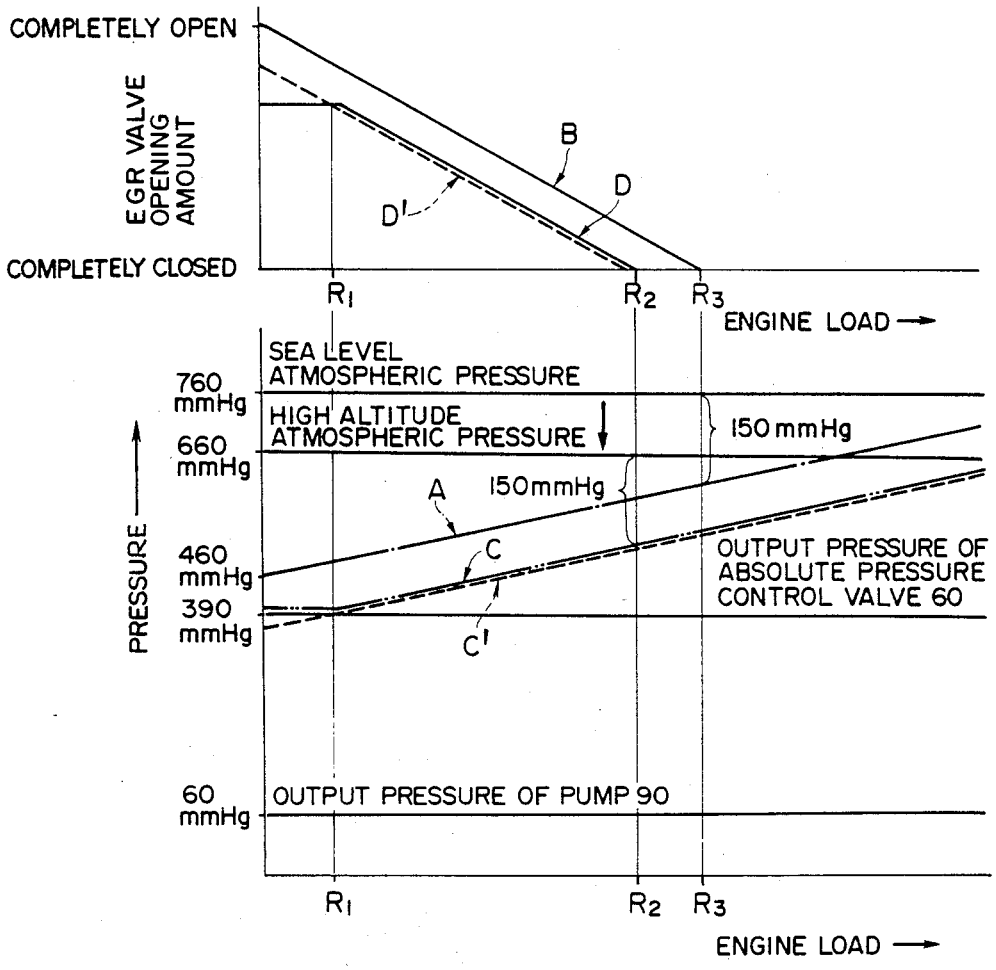
FIG. 2 is a compound graph relating to the operation of said first preferred embodiment of the present invention, in which engine load is shown along the horizontal axis and in a first part thereof an opening amount of an exhaust gas recirculation valve is shown on the vertical axis and in a second part thereof certain pressures are shown on said vertical axis.

Now, the pressure in the reference pressure chamber 52 of the vacuum control valve 30 is substantially equal to the output pressure of the vacuum pump 90, which does not depend upon atmospheric pressure but is substantially constant, exemplary being 60 mmHg as shown at the bottom of FIG. 2, and hence the effect of alteration of this pressure on the operation of the vacuum control valve 30 can be ignored.

The vacuum control valve 30 receives in its pressure chamber 48, via the input port 56 and the conduit 57, from the regulator valve 80, a pressure the difference of which from the current value of atmospheric pressure depends upon the current value of engine load and decreases with increase of engine load (said pressure in the pressure chamber 48 increasing), and accordingly, as explained above with respect to the operation of the vacuum control valve 30, provided that sufficiently low pressure supply is available thereto from the absolute pressure control valve 60, there is produced at the output port 32 of the vacuum control valve 30 a pressure value which has the same type of alteration characteristics with respect to engine load, although perhaps with different proportionality constant, as said pressure in the pressure chamber 48: in other words, the output pressure of the vacuum control valve 30 at its output port 32 differs from the current value of atmospheric pressure by an amount which is maximum at minimum engine load and decreases substantially linearly as engine load increases. This output pressure of the vacuum control valve 30, the variation of which with respect to engine load which is shown in the case of normal or sea level atmospheric pressure equal to 760 mmHg by the single dotted line A in FIG. 2, is supplied to the pressure chamber 22 of the exhaust gas recirculation control valve 12, which is accordingly operated, in this sea level 760 mmHg atmospheric pressure case, as shown by the solid line B in FIG. 2. In detail, to consider the exemplary pressure values shown by FIG. 2, in which case the substantially fixed absolute pressure output by the absolute pressure control valve 60 is assumed to be approximately 390 mmHg: at minimum engine load the output pressure of the vacuum control valve 30 is approximately 460 mmHg, which said vacuum control valve 30 is capable of providing since the pressure supply fed thereto from the absolute pressure control valve 60 is below this desired output pressure value of 460 mmHg. Thus this 460 mmHg output pressure value, when supplied to the pressure chamber 22 of the exhaust gas recirculation control valve 12, provides an effective vacuum value in said pressure chamber 22 of 300 mmHg, which is just sufficient to open said exhaust gas recirculation control valve 12 fully so as to provide the maximum amount of exhaust gas recirculation to the diesel engine 1. As engine load is increased from this minimum value, the value of the output pressure of the vacuum control valve 30 is steadily and linearly increased as shown by the line A, and this means that the effective vacuum value supplied to the pressure chamber 22 of the exhaust gas recirculation control valve 12 steadily decreases, so that exhaust gas recirculation control valve 12 is steadily and linearly closed so as to reduce the exhaust gas recirculation amount supplied to the diesel engine 1. This process continues along with increasing engine load, until at an engine load equal to a certain value R3 said vacuum value supplied to the pressure chamber 22 of the exhaust gas recirculation control valve 12 (the difference between the output pressure of the vacuum control valve 30 and atmospheric pressure) becomes equal to 150 mmHg, the minimum opening pressure for said exhaust gas recirculation control valve 12, and at this point the exhaust gas recirculation control valve 12 comes to be fully closed (and of course stays fully closed with further increase of engine load; at near maximum engine load the output pressure of the vacuum control valve 30 is approximately the current atmospheric pressure of 760 mmHg). Thus, in summary, the variation in the opening amount of the exhaust gas recirculation control valve 12 with increasing engine load, at normal or sea level atmospheric pressure, is as follows: from a maximum full open value at minimum engine load, it varies steadily and linearly downwards, to become zero at the engine load value R3, and remains zero thereafter.

On the other hand, when the vehicle incorporating this diesel engine 1 and this exhaust gas recirculation system is being operated at a high altitude, exemplarily at an altitude at which the atmospheric pressure is 660 mmHg, then this decrease in the atmospheric pressure causes a decrease in the difference between the output pressure of the regulator valve 80 and atmospheric pressure, i.e. causes a decrease in the vacuum depression value of the output of said regulator valve 80, with respect to the same engine load, since, although the absolute value of said output pressure of said regulator valve 80 is reduced, atmospheric pressure is more reduced. At this lower atmospheric pressure, correspondingly, the difference between the output pressure of the vacuum control valve 30 and atmospheric pressure is reduced, with respect to the same engine load, since likewise, although the aboslute value of said output pressure of said vacuum control valve 30 is reduced, atmospheric pressure is further reduced. In this case, the variation of the output pressure of the vacuum control valve 30 is indicated by the double dashed line C in FIG. 2. Further, what the variation of the output pressure of the vacuum control valve 30 would be, if the vacuum value supplied to the port 31 thereof were sufficiently low, is shown by the dashed line C' in FIG. 2. According to this dashed line C', it is seen that, if the vacuum value supplied to the port 31 were sufficiently low, then at minimum engine load the output pressure of the vacuum control valve 30 would be well below 390 mmHg, but, since said vacuum control valve 30 is not capable of providing such a low pressure value since the pressure supply fed thereto from the absolute pressure control valve 60 is always substantially equal to a value of 390 mmHg, therefore the output pressure of said vacuum control valve 30 is only equal to this supplied pressure of 390 mmHg, and in this case the valve member assembly 111 does not reciprocate to and fro in the aforementioned regulatory movement. Thus this 390 mmHg output pressure value, when supplied to the pressure chamber 22 of the exhaust gas recirculation control valve 12, provides an effective vacuum value in said pressure chamber 22 of only 270 mmHg, which is not sufficient to open said exhaust gas recirculation control valve 12 fully so as to provide the maximum possible amount of exhaust gas recirculation to the diesel engine 1, but only partially opens said exhaust gas recirculation control valve 12 so that it only provides a partial amount of exhaust gas recirculation. In this lower atmospheric pressure case, the variation of the opening amount of the exhaust gas recirculation control valve 22 with engine load is indicated by the solid line D in FIG. 2. Further, what the variation of the opening amount of the exhaust gas recirculation control valve 22 with engine load would be, if the vacuum value supplied to the port 31 of the vacuum control valve 30 were sufficiently low, is shown by the dashed line D' in FIG. 2. As engine load is increased from this minimum value, the value of the output pressure of the vacuum control valve 30 remains steady at 390 mmHg until engine load reaches the value R1 as shown by the line C, although what this output pressure would be if the pressure at the port 31 were low enough is steadily and linearly increased as shown by the line C', and this means that the effective vacuum value supplied to the pressure chamber 22 of the exhaust gas recirculation control valve 12 remains constant (although what it would be under the above supposition steadily decreases), so that said exhaust gas recirculation control valve 12 is kept at the same partial opening amount, to provide a constant amount of exhaust gas recirculation to the diesel engine 1. On the other hand, once the engine load rises to be above this value R1, then as engine load further increases the value of the output pressure of the vacuum control valve 30 is steadily and linearly increased as shown by the line C, and this means that the effective vacuum value supplied to the pressure chamber 22 of the exhaust gas recirculation control valve 12 steadily decreases, so that said exhaust gas recirculation control valve 12 is steadily and linearly closed so as to reduce the exhaust gas recirculation amount supplied to the diesel engine 1, as shown by the line D. This process continues along with increasing engine load, until at an engine load equal to a certain value R2, which is less than the previous value R3, said vacuum value supplied to the pressure chamber 22 of the exhaust gas recirculation control valve 12 (the difference between the output pressure of the vacuum control valve 30 and atmospheric pressure) becomes equal to 150 mmHg, the minimum opening pressure for said exhaust gas recirculation control valve 12, and at this point the exhaust gas recirculation control valve 12 comes to be fully closed (and of course stays fully closed with further increase of engine load; at near maximum engine load the output pressure of the vacuum control valve 30 is again equal to approximately the current atmospheric pressure of 660 mmHg). Thus, in summary, the variation in the opening amount of the exhaust gas recirculation control valve 12 with increasing engine load, at this lower atmospheric pressure, is as follows: from a partly open value at minimum engine load, it remains the same until a certain engine load value, and thereafter varies steadily and linearly downwards, to become zero at the engine load value R2, and remains zero thereafter.

Thus, considering this performance of opening of the exhaust gas recirculation control valve 12, according to the shown first preferred embodiment of the present invention, it is linear when the atmospheric pressure is that at sea level, but at an elevated altitude where the atmospheric pressure is less the graphic representation of the opening amount of the exhaust gas recirculation control valve 12 is truncated, so that said valve never opens more than a certain amount; and also said graph is shifted leftwards as seen in FIG. 2, so that the opening amount for an engine load value is always less than the corresponding opening amount at sea level, and by an amount determined by the amount by which the current atmospheric pressure is less than sea level pressure. Thus, the exhaust gas recirculation ratio for the diesel engine 1 is reduced under all engine load conditions, but is particularly reduced more in the low load engine operational condition than in the medium to high load operational condition. This effect is produced by limiting the output pressure of the vacuum control valve 30 by supplying it with negative pressure from the absolute pressure control valve 60, because said valve 30 cannot supply a lower pressure than that with which it is supplied. As a result, altitude compensation for the engine 1 is performed in a higher amount and at a greater ratio in the low load engine operational condition than in the medium to high load operational condition. Accordingly, at high altitudes it is possible to avoid the situation where the engine lacks air in such low engine load operational regions and thus should be subject to the emission of white smoke, and also engine misfiring and poor drivability and the like in these low engine load operational regions are avoided. However, if the vacuum control valve 30 were only directly supplied with vacuum to be modified directly from the pump 90, rather than from the absolute pressure control valve 60, then the performance of operation of the exhaust gas recirculation control valve 12 would appear like the dashed line D' in FIG. 2, and would be the same for all engine load values and not be increased at low engine loads; and accordingly not enough exhaust gas recirculation would be provided at low engine loads, and there would be a danger of the engine lacking air in such low engine load operational regions and emitting white smoke, and moreover the engine might also perhaps misfire and be characterized by poor drivability or similar drawbacks.

Figure 3:
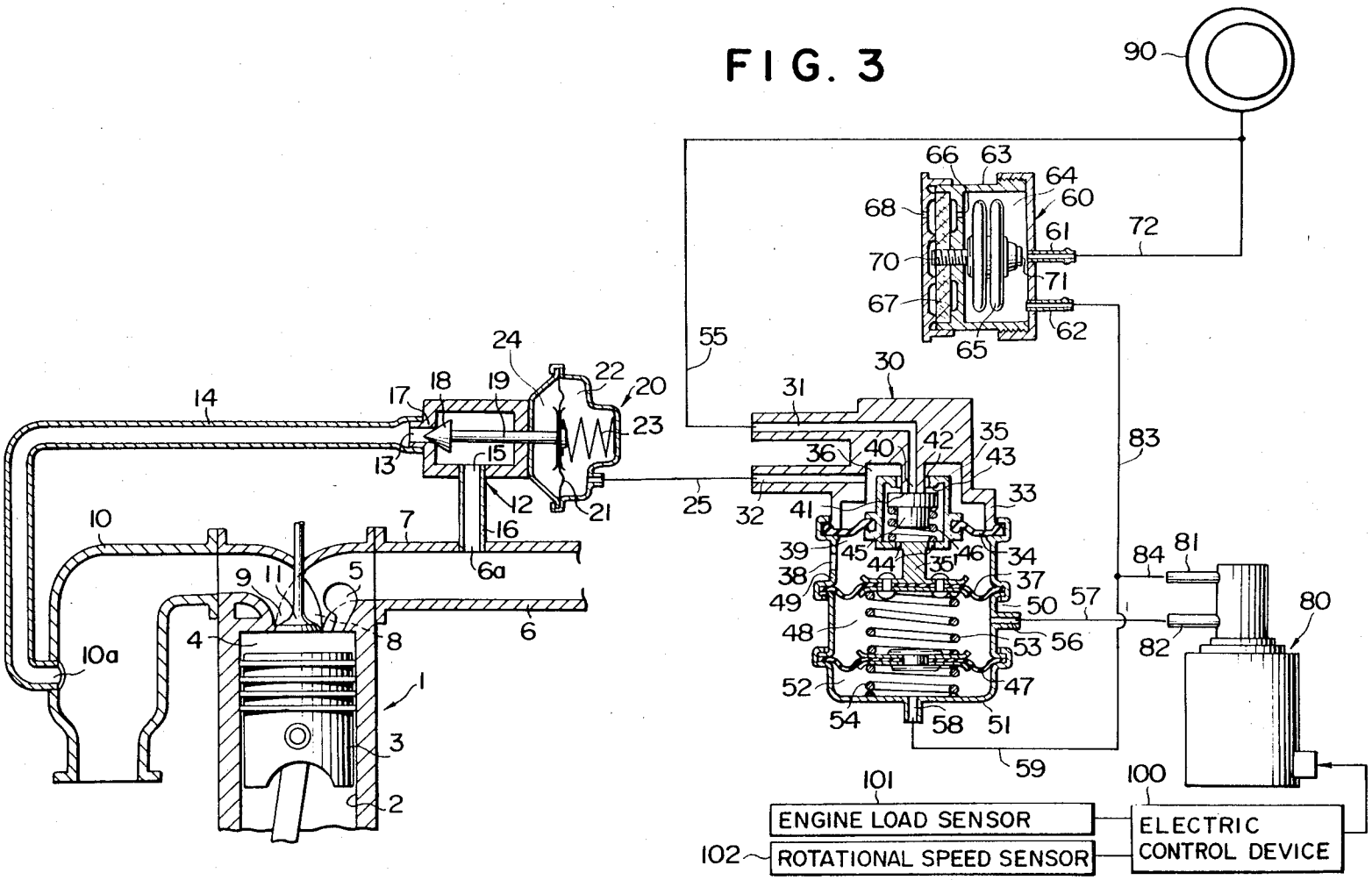
FIG. 3 is a schematic part sectional view, similar to FIG. 1, showing parts of a diesel engine and of the second preferred embodiment of the diesel exhaust gas recirculation system of the present invention in cross section.
Figure 4:
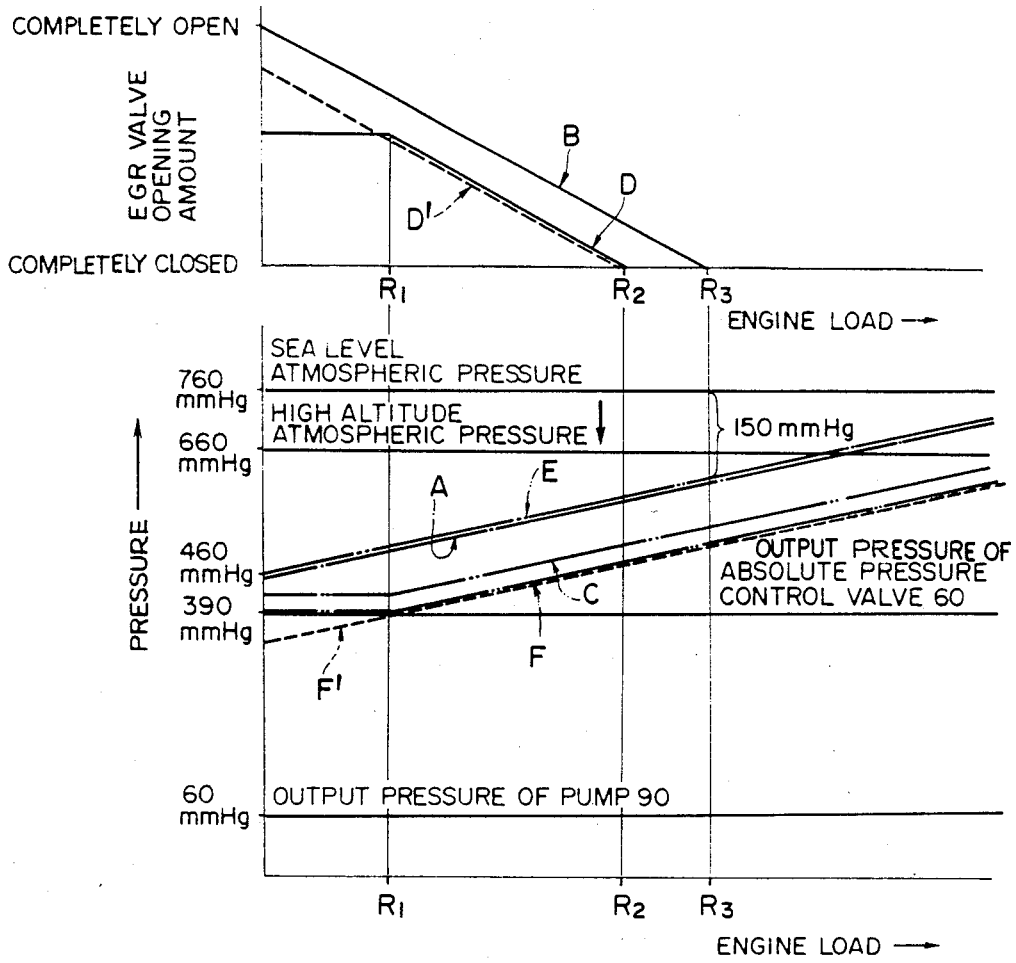
FIG. 4 is a compound graph, similar to FIG. 2, but relating to the operation of said second preferred embodiment of the present invention, in which again the engine load is shown along the horizontal axis and in a first part thereof an opening amount of the exhaust gas recirculation valve is shown on the vertical axis and in a second part thereof certain pressures are shown on said vertical axis.

In FIG. 3, there is schematically shown a diesel engine and the second preferred embodiment of the diesel exhaust gas recirculation system of the present invention, in a fashion similar to FIG. 1 with respect to the first preferred embodiment; and in FIG. 4 illustrative graphs are shown relating to the performance of this second preferred embodiment, in a fashion similar to FIG. 2 with respect to the first preferred embodiment. In FIG. 3, like parts of the first embodiment in FIG. 1 are designated by the same reference symbols. In this second preferred embodiment, there are incorporated an exhaust gas recirculation control valve 12, a vacuum control valve 30, an absolute pressure control valve 60, a regulator valve 80, and a vacuum pump 90, as in the first preferred embodiment of FIG. 1; and in fact the internal structures and the individual functions of these parts are the same as in the first preferred embodiment, and accordingly description thereof will be foregone in the interests of brevity and conciseness. However, the interconnection of these devices is different in this second preferred embodiment: in detail, the regulated pressure port 31 of the vacuum control valve 30 is connected to receive supply of vacuum directly from the output of the pump 90, via a conduit 55; the input port 61 of said absolute pressure valve 60 also is connected to receive supply of vacuum directly from the output of said pump 90, via a conduit 72; the output port 62 of said absolute pressure valve 60 is connected to the input port 81 of the regulator valve 80, via a conduit 83 and a conduit 84, and is also connected to the reference pressure port 58 of the vacuum control valve 30 via a conduit 59 and said conduit 83; and as before the output port 32 of the vacuum control valve 30 is connected to the input port 22*a* of the exhaust gas recirculation control valve 12 via the conduit 25. The control device 100, and its associated sensors 101 and 102, are quite the same as in the first preferred embodiment of FIG. 1.

Now, with reference to the graph of FIG. 4, the function of this second preferred embodiment of the diesel exhaust gas recirculation system of the present invention will be explained. In this explanation, again, various exemplary pressure values used or attained during the operation of a particular version of the system, operating in particular circumstances, will be cited; however, again, these are not intended to be limiting, but instead are merely explicative.

First, with regard to the operation of the exhaust gas recirculation control valve 12, this valve is operated in the same way as in the first preferred embodiment according to the relative negative pressure (or the depression) supplied to the pressure chamber 22 of its diaphragm actuator 20 from the output port 32 of the vacuum control valve 30. In the graphs of FIG. 4, again, it is assumed for explanation's sake that this exhaust gas recirculation control valve 12 has the same characteristic as before: that it remains closed—i.e. valve element 18 remains pressed against the valve seat 17—until the absolute pressure in the pressure chamber 22 drops to more than 150 mmHg below atmospheric pressure, and then starts to open—i.e. valve element 18 starts to move rightwards away from valve seat 17—until, when the absolute pressure in the pressure chamber 22 has dropped to more than 300 mmHg below atmospheric pressure, it is fully open—i.e. valve element 18 has fully moved away from valve seat 17 to the maximum possible amount.

Now, the pressure in the reference pressure chamber 52 of the vacuum control valve 30 is substantially equal to the output pressure of the absolute pressure control valve 60, which does not depend upon atmospheric pressure but is substantially constant, exemplarily being 390 mmHg as shown in FIG. 4, and hence the effect of alteration of this pressure on the operation of the vacuum control valve 30 again can be ignored.

The regulator valve 80 receives at input port 81, from the regulator valve 80, via the conduits 83 and 84, a constant pressure of an exemplarily value of 390 mmHg, and accordingly, as explained above with respect to the operation of the regulator valve 80, provided that sufficiently low pressure supply is available thereto from the absolute pressure control valve 60, there is produced at the output port 82 of regulator valve 80 a pressure value the difference of which from the current value of atmospheric pressure depends upon the current value of engine load and decreases with increase of engine load (the absolute value of said pressure at the output port 82 increasing, and the variation of said pressure with respect to engine load being shown in the case of normal or sea level atmospheric pressure equal to 760 mmHg by the double dotted line E in FIG. 4, and this pressure is received by the vacuum control valve 30 in its pressure chamber 48, via the input port 56 and the conduit 57, and accordingly, as explained above with respect to the operation of the vacuum control valve 30, since definitely a sufficiently low pressure supply is available thereto from the absolute pressure control valve 60 (this pressure supply being as before taken as exemplarily 60 mmHg), there is produced at the output port 32 of the vacuum control valve 30 a pressure value which has the same type of alteration characteristics with respect to engine load as said pressure in the pressure chamber 48: in other words, the output pressure of the vacuum control valve 30 at output port 32 differs from the current value of atmospheric pressure by an amount which is maximum at minimum engine load and decreases substantially linearly as engine load increases. This output pressure of the vacuum control valve 30, the variation of which with respect to engine load which is shown in the case of normal or sea level atmospheric pressure equal to 760 mmHg by the single dotted line A in FIG. 4, is supplied to the pressure chamber 22 of the exhaust gas recirculation control valve 12, which is accordingly operated, in this sea level 760 mmHg atmospheric pressure case, as shown by the solid line B in FIG. 4. In detail, to consider the exemplary pressure values shown by FIG. 4, in which case the substantially fixed absolute pressure output by the absolute pressure control valve 60 is assumed to be approximately 390 mmHg: at minimum engine load the output pressure of the regulator valve 80 is approximately 460 mmHg, which said regulator valve 80 is capable of providing since the pressure supply fed thereto from the absolute pressure control valve 60 is below this desired output pressure value of 460 mmHg. Thus this 460 mmHg output pressure value, when supplied to the pressure chamber 48 of the vacuum control valve 30, causes it to output an output pressure also of approximately 460 mmHg to the pressure chamber 22 of the exhaust gas recirculation control valve 12, which provides an effective vacuum value in said pressure chamber 22 of 300 mmHg, which is just sufficient to open said exhaust gas recirculation control valve 12 fully so as to provide the maximum possible amount of exhaust gas recirculation to the diesel engine 1. As engine load is increased from this minimum value, the value of the output pressure of the regulator valve 80 is steadily and linearly increased as shown by the line E, and according to this the output pressure of the vacuum control valve 30 is steadily and linearly increased as shown by the line A, and this means that the effective vacuum value supplied to the pressure chamber 22 of the exhaust gas recirculation control valve 12 steadily decreases, so that said exhaust gas recirculation control valve 12 is steadily and linearly closed so as to reduce the exhaust gas recirculation amount supplied to the diesel engine 1. This process continues along with increasing engine load, until at an engine load equal to a certain value R3 said vacuum value supplied to the pressure chamber 22 of the exhaust gas recirculation control valve 12 (the difference between the output pressure of the vacuum control valve 30 and atmospheric pressure) becomes equal to 150 mmHg, the minimum opening pressure for said exhaust gas recirculation control valve 12, and at this point the exhaust gas recirculation control valve 12 comes to be fully closed (and of course stays fully closed with further increase of engine load; at near maximum engine load the output pressures of the regulator valve 80 and of the vacuum control valve 30 are approximately equal to the current atmospheric pressure of 760 mmHg). Thus, in summary, the variation in the opening amount of the exhaust gas recirculation control valve 12 with increasing engine load, at normal or sea level atmospheric pressure, as before with respect to the first preferred embodiment, is as follows: from a maximum full open value at minimum engine load, it varies steadily and linearly downwards, to become zero at the engine load value R3, and remains zero thereafter.

On the other hand, when the vehicle incorporating this diesel engine 1 and this exhaust gas recirculation system is being operated at a high altitude, again exemplarily at an altitude at which the atmospheric pressure is 660 mmHg, then this decrease in the atmospheric pressure causes a decrease in the difference between the output pressure of the regulator valve 80 and atmospheric pressure, i.e. causes a decrease in the vacuum depression value of the output of regulator valve 80, with respect to the same engine load, since, although the absolute value of said output pressure of regulator valve 80 is reduced, atmospheric pressure is more reduced. Further, at this lower atmospheric pressure, correspondingly, the difference between the output pressure of the vacuum control valve 30 and atmospheric pressure is reduced, with respect to the same engine load, since likewise, although the absolute value of said output pressure of vacuum control valve 30 is reduced, atmospheric pressure is more reduced. In this case, the variation of the output pressure of the regulator valve 80 is indicated by the double dashed line F in FIG. 4, and the variation of the output pressure of the vacuum control valve 30 is indicated by the double dashed line C in FIG. 4. Further, what the variation of the output pressure of the regulator valve 80 would be, if the vacuum value supplied to the port 81 thereof were sufficiently low, is shown by the dashed line F' in FIG. 4. According to this dashed line F', it is seen that, if the vacuum value supplied to the port 81 were sufficiently low, then at minimum engine load the output pressure of the regulator valve 80 would be well below 390 mmHg, but, since regulator valve 80 is not capable of providing such a low pressure value since the pressure supply fed thereto from the absolute pressure control valve 60 is always substantially equal to a value of 390 mmHg, therefore the output pressure of regulator valve 80 is only equal to this supplied pressure of 390 mmHg. Thus this 390 mmHg output pressure value, when supplied to the pressure chamber 48 of the vacuum control valve 30, causes a pressure as shown by the line C to be generated, which causes the exhaust gas recirculation control valve 12 to provide an effective vacuum value in its pressure chamber 22 of less than 300 mmHg, which is not sufficient to open said exhaust gas recirculation control valve 12 fully so as to provide the maximum possible amount of exhaust gas recirculation to the diesel engine 1, but only partially opens exhaust gas recirculation control valve 12 so that it only provides a partial amount of exhaust gas recirculation. In this lower atmospheric pressure case, the variation of the opening amount of the exhaust gas recirculation control valve 22 with engine load is indicated by the solid line D in FIG. 4. Further, what the variation of the opening amount of the exhaust gas recirculation control valve 22 with engine load would be, if the vacuum value supplied to the port 81 of the regulator valve 80 were sufficiently low, is shown by the dashed line D' in FIG. 4. As engine load is increased from this minimum value, the value of the output pressure of the regulator valve 80 remains steady at 390 mmHg until engine load reaches the value R1 as shown by the line F, although what this output pressure would be if the pressure at the port 81 were low enough is steadily and linearly increased as shown by the line F', and correspondingly the value of the output pressure of the vacuum control valve 30 remains steady until engine load reaches said value R1 as shown by the line C, and this means that the effective vacuum value supplied to the pressure chamber 22 of the exhaust gas recirculation control valve 12 remains constant (although what it would be under the above supposition steadily decreases), so that exhaust gas recirculation control valve 12 is kept at the same partial opening amount, to provide a constant amount of exhaust gas recirculation to the diesel engine 1. On the other hand, once engine load rises to be above this value R1, then as engine load further increases the value of the output pressure of the regulator valve 80 is steadily and linearly increased as shown by the line F, and accordingly the value of the output pressure of the vacuum control valve 30 is steadily and linearly increased as shown by the line C, and this means that the effective vacuum value supplied to the pressure chamber 22 of the exhaust gas recirculation control valve 12 steadily decreases, so that exhaust gas recirculation control valve 12 is steadily and linearly closed so as to reduce the exhaust gas recirculation amount supplied to the diesel engine 1, as shown by the line D. This process continues along with increasing engine load, until at an engine load equal to a certain value R2, which is less than the previous value R3, said vacuum value supplied to the pressure chamber 22 of the exhaust gas recirculation control valve 12 (the difference between the output pressure of the vacuum control valve 30 and atmospheric pressure) becomes equal to 150 mmHg, the minimum opening pressure for exhaust gas recirculation control valve 12, and at this point the exhaust gas recirculation control valve 12 comes to be fully closed (and of course stays fully closed with further increase of engine load; at near maximum engine load the output pressures of the regulator valve 80 and of the vacuum control valve 30 are again equal to approximately the current atmospheric pressure of 660 mmHg). Thus, in summary, the variation in the opening amount of the exhaust gas recirculation control valve 12 with increasing engine load, at this lower atmospheric pressure, is: from a partly open value at minimum engine load, it remains the same until a certain engine load value, and thereafter it varies steadily and linearly downwards, to become zero at the engine load value R2, and it remains zero thereafter.

Thus, considering this performance of opening of the exhaust gas recirculation control valve 12, according to the shown second preferred embodiment of the present invention, it is linear when the atmospheric pressure is equal to that at sea level, but at an elevated altitude where the atmospheric pressure is lesser the graphic representation of the opening amount of the exhaust gas recirculation control valve 12 is truncated, so that said valve never opens more than a certain amount; and also said graph is as before in the first preferred embodiment shifted leftwards as seen in FIG. 4, so that the opening amount for an engine load value is always less than the corresponding opening amount at sea level, and by an amount determined by the amount by which the current atmospheric pressure is less than sea level pressure. Thus, the exhaust gas recirculation ratio for the diesel engine 1 is reduced under all engine load conditions, but is particularly reduced more in the low load engine operational condition than in the medium to high load operational condition. This effect is produced by limiting the output pressure of the regulator valve 80 by supplying it with negative pressure from the absolute pressure control valve 60, because valve 80 cannot supply a lower pressure than that with which it is supplied. As a result, altitude compensation for the engine 1 is performed in a higher amount and at a greater ratio in the low load engine operational condition than in the medium to high load operational condition, as it was in the first preferred embodiment, but by a different construction. Accordingly, again, at high altitudes it is avoided that the engine should lack air in such low engine load operational regions and thus should be subject to the emission of white smoke, and also engine misfiring and poor drivability and the like in these low engine load operational regions are avoided. However, if the regulator valve 80 were only directly supplied with vacuum to be modified directly from the pump 90, rather than from the absolute pressure control valve 60, then the performance of operation of the exhaust gas recirculation control valve 12 would appear like the dashed line D' in FIG. 4, and would be the same for all engine load values and not be increased at low engine loads; and accordingly not enough exhaust gas recirculation would be provided at low engine load, and there would be a danger of the engine lacking air in such low engine load operational regions and emitting white smoke, and the engine might also perhaps misfire and have poor drivability or the like.

Although the present invention has been shown and described with reference to the preferred embodiments thereto, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. An exhaust gas recirculation system for a diesel engine for a vehicle utilizing an air intake system and an exhaust system, comprising:

(a) an exhaust gas recirculation passage a downstream end of which is connected to said exhaust system and an upstream end of which is connected to said air intake system, so as to recirculate exhaust gas from said exhaust system to said air intake system;

(b) an exhaust gas recirculation control valve comprising a pressure chamber, which regulates flow resistance of said exhaust gas recirculation passage according to an amount by which the pressure in said pressure chamber is lower than ambient atmospheric pressure, so as to regulate a flow amount of said recirculation of exhaust gas from said exhaust system to said air intake system;

(c) means for providing a supply of low pressure;

(d) an absolute pressure control valve, comprising an input port and an output port, which receives supply of low pressure from said means for providing low pressure at said input port, and which provides a supply of pressure at said output port the absolute pressure value of which is substantially fixed;

(e) a regulator valve comprising an input port and an output port, said regulator valve receiving at said input port a supply of said pressure at said output port of said absolute pressure control valve the absolute pressure value of which is substantially fixed, and producing at said output port an output pressure value which depends upon engine load; and (f) a vacuum control valve comprising a pressure regulating chamber which receives a supply of pressure from said means for providing low pressure and an output port opening from said pressure regulating chamber, and in accordance with increasing engine load increasing an absolute pressure value at and below which pressure in said pressure regulating chamber is bled to atmosphere, and further comprising a control chamber which receives supply of said output pressure value from said output port of said regulator valve and which controls the bleeding of said pressure regulating chamber to atmosphere according to the pressure therein by altering said certain pressure value, and said output port of said vacuum control valve being communicated to said pressure chamber of said exhaust gas recirculation control valve.

2. An exhaust gas recirculation control system according to claim 1, wherein said exhaust gas recirculation control valve controls flow resistance of said exhaust gas recirculation passage to be maximum when the pressure in said pressure chamber of said exhaust gas recirculation control valve is lower than the ambient atmospheric pressure by less than a first predetermined amount, thereafter decreases flow resistance of said exhaust gas recirculation passage as the difference between the pressure in said pressure chamber and the ambient atmospheric pressure rises above said first predetermined amount while such is still below a second predetermined amount, and controls flow resistance of said exhaust gas recirculation passage to be minimum when the pressure in said pressure chamber is lower than the ambient atmospheric pressure by more than said second predetermined amount.

3. An exhaust gas recirculation control system according to claim 1, wherein operation of said regulator with respect to change of ambient atmospheric pressure is such that, when ambient atmospheric pressure is such as is typical for low altitude vehicle operation, said absolute pressure value of the pressure at said output port of said absolute pressure control valve is less than the output pressure which said regulator valve is adapted to produce, for substantially all engine load values; but, when ambient atmospheric pressure is such as is typical for high altitude vehicle operation, said absolute pressure value of the pressure at said output port of said absolute pressure control valve is greater than said output pressure which said regulator valve is adapted to produce in the circumstances of low engine values, and is less than said output pressure which said regulator valve is adapted to produce in the circumstances of medium and high engine load values.

4. An exhaust gas recirculation control system according to claim 3, wherein said exhaust gas recirculation control valve controls flow resistance of said exhaust gas recirculation passage to be maximum when the pressure in said pressure chamber of said exhaust gas recirculation control valve is lower than ambient atmospheric pressure by less than a first predetermined amount, thereafter decreases flow resistance of said exhaust gas recirculation passage as the difference between the pressure in said pressure chamber and ambient atmospheric pressure rises above said first predetermined amount while it is still below a second predetermined amount, and controls flow resistance of said exhaust gas recirculation passage to be minimum when the pressure in said pressure chamber is lower than ambient atmospheric pressure by more than said second predetermined amount.

5. An exhaust gas recirculation system for a diesel engine for a vehicle utilizing an air intake system and an exhaust system, comprising:

(a) an exhaust gas recirculation passage a downstream and of which is connected to said exhaust system and an upstream end of which is connected to said air intake system, so as to recirculate exhaust gas from said exhaust system to said air intake system;

(b) an exhaust gas recirculation control valve comprising a pressure chamber, which regulates flow resistance of said exhaust gas recirculation passage according to an amount by which the pressure in said pressure chamber is lower than ambient atmospheric pressure, so as to regulate a flow amount of said recirculation of exhaust gas from said exhaust system to said air intake system;

(c) means for providing a supply of low pressure;

(d) an absolute pressure control valve, comprising an input port and an output port, which receives supply of low pressure from said means for providing low pressure at said input port, and which provides a supply of a pressure at said output port an absolute pressure value of which is substantially fixed; and (e) a vacuum control valve comprising a pressure regulating chamber receives a supply of pressure from said output port of said absolute pressure control valve, and further comprising an output port opening from said pressure regulating chamber, said vacuum control valve being controlled according to engine load, and bleeding to atmosphere said pressure regulating chamber when the pressure therein is not greater than a certain pressure value, said certain pressure valve increasing in accordance with increasing engine load; and said output port of said vacuum control valve being communicated to said pressure chamber of said exhaust gas recirculation control valve.

6. An exhaust gas recirculation control system according to claim 5, further comprising a regulator valve comprising an input port and an output port, said regulator valve receiving a supply of low pressure from said means for providing low pressure at said input port, and producing at said output port an output pressure value which depends upon engine load; and wherein said vacuum control valve further comprises a control chamber which receives a supply of said output pressure value from said output port of said regulator valve and which controls bleeding of said pressure regulating chamber of said vacuum control valve to atmosphere according to the pressure therein by altering said certain pressure value.

7. An exhaust gas recirculation control system according to claim 5, wherein said exhaust gas recirculation control valve controls flow resistance of said exhaust gas recirculation passage to be maximum when the pressure in said pressure chamber of said exhaust gas recirculation control valve is lower than ambient atmospheric pressure by less than a first predetermined amount, thereafter decreases flow resistance of said exhaust gas recirculation passage as a difference between the pressure in said pressure chamber and the ambient atmospheric pressure rises above said first predetermined amount while it is still below a second predetermined amount, and controls flow resistance of said exhaust gas recirculation passage to be minimum when the pressure in said pressure chamber is lower than ambient atmospheric pressure by more than said second predetermined amount.

8. An exhaust gas recirculation control system according to claim 5, wherein operation of said vacuum control valve with respect to change of ambient atmospheric pressure is such that, when ambient atmospheric pressure is such as is typical for low altitude vehicle operation, said absolute pressure value of the pressure at said output port of said absolute pressure control valve is less than said absolute pressure value at and below which pressure in said pressure regulating chamber of said vacuum control valve is bled to atmosphere, for substantially all engine load values; but, when the ambient atmospheric pressure is such as is typical for high altitude vehicle operation, said absolute pressure value of the pressure at said output port of said absolute pressure control valve is greater than said absolute pressure value at and below which pressure in said pressure regulating chamber of said vacuum control valve is bled to atmosphere, for low engine load values, and is less than said absolute pressure value at and below which pressure in said pressure regulating chamber of said vacuum control value is bled to atmosphere, for medium and high engine load values.

9. An exhaust gas recirculation control system according to claim 8, wherein said exhaust gas recirculation control valve controls flow resistance of said exhaust gas recirculation passage to be maximum when the pressure in said pressure chamber of said exhaust gas recirculation control valve is lower than the ambient atmospheric pressure by less than a first predetermined amount, thereafter decreases flow resistance of said exhaust gas recirculation passage as a difference between the pressure in said pressure chamber and the ambient atmospheric pressure rises above said first predetermined amount while it is still below a second predetermined amount, and controls flow resistance of said exhaust gas recirculation passage to be minimum when the pressure in said pressure chamber is lower than ambient atmospheric pressure by more than said second predetermined amount.

* * * * *